United States Patent [19]

Krieger

[11] 4,233,916

[45] Nov. 18, 1980

[54] PROCESS AND APPARATUS FOR PRODUCING CONTINUOUS EMBROIDERED FABRICS

[75] Inventor: David Krieger, Greenville, S.C.

[73] Assignee: Emb-Tex Corporation, Travelers Rest, S.C.

[21] Appl. No.: 868,365

[22] Filed: Jan. 10, 1978

[51] Int. Cl.[2] ..... D05C 7/04; D05B 27/00

[52] U.S. Cl. ..... 112/90; 112/102; 112/121.26; 112/305; 26/51

[58] Field of Search ..... 112/90, 91, 92, 86, 112/102, 121.26, 305; 26/51

[56] References Cited

U.S. PATENT DOCUMENTS

| | | | |
|---|---|---|---|
| 435,876 | 9/1890 | Willcox et al. | 112/90 X |
| 1,190,021 | 7/1916 | Sieber | 112/90 |
| 1,190,022 | 7/1916 | Sieber | 112/90 |
| 1,193,303 | 8/1916 | Sieber | 112/90 |
| 1,195,809 | 8/1916 | Groebli | 112/90 |
| 1,460,612 | 7/1923 | Sieber | 112/90 |

*Primary Examiner*—H. Hampton Hunter
*Attorney, Agent, or Firm*—Sprung, Felfe, Horn, Lynch & Kramer

[57] ABSTRACT

Continuous unseamed lengths of embroidered fabric are produced by a special process and apparatus therefor. Fabric to be embroidered upon is pulled off a vertical bolt and engaged at its upper edge by pins on an endless belt which is actuated to advance the fabric across the face of an embroidery apparatus. Then the lower edge of the fabric is tensioned transversely. Embroidery proceeds and then the embroidery yarns are cut. A release member disengages the lower edge of the fabric, the belt is actuated to advance the fabric, disengage its upper edge from its pins, to move the embroidered fabric onto a collection bolt and to position a new section of the fabric in the embroidery area. The upstream rear end of the embroidered section of fabric is registered so the new embroidery will be continuous with that just completed, and the operation is repeated.

7 Claims, 10 Drawing Figures

PROCESS AND APPARATUS FOR PRODUCING CONTINUOUS EMBROIDERED FABRICS

This invention relates to an apparatus for producing continuous unseamed lengths of embroidered fabric by the transverse embroidering of successive contiguous lengths of a base fabric.

Embroidery machines conventionally operate on relatively long lengths of fabric. The loom receives a length of perhaps 45 feet and embroiders transversely of the fabric. When complete, the fabric is removed, another 45-foot length is cut from the original bolt and the process repeated. The machine actually requires about 47 feet, an extra foot at each end being needed for clamping and the like but not being embroidered upon. Thus, this is pure waste.

At the end of the operation the lengths must be sewn together to re-form a bolt. In addition to the two-foot waste of unembroidered fabric, there is often other waste as well. Thus if a particular garment requires 4 feet of embroidery, there will be eleven repeats in one length plus an extra foot of embroidery. This foot can be "saved" by stitching to the next length but such seams may be undesirable. At the least, a sewing operation is required.

In an effort to increase machine capacity, embroidery machines have been made which operate on fabrics as mush as 12 feet in width. Since fabrics do not normally come in such widths, three fabric lengths of about 47 feet and each 4 feet wide are sewn longitudinally to form a 12-foot width and this is embroidered upon. Thereafter it becomes necessary to separate the lengths longitudinally and then sew them transversely to make up long lengths of 4-foot wide embroidered fabric.

The need for sewing and severing offsets much of the economy attending use of the wider fabric. In addition, when working on the 47-foot length either in 4 or 12-foot width there is much machine downtime as the operator positions the fabric and moves across the full machine width several times to ensure proper positioning of the fabric and the means which hold it in place during embroidering.

It is accordingly an object of the present invention to provide an embroidery machine which can operate without the need for cutting lengths of fabric, i.e. on lengthy bands of fabric.

It is another object of the invention to provide an embroidery machine which operates with minimum downtime between cycles and with minimum operator requirement.

These and other objects are realized in accordance with the present invention pursuant to which a conventional embroidery machine, having means for piercing a fabric with embroidery yarns, is provided with a special fabric placement and advancement frame. This frame is provided with means for taking the fabric from a supply, means for advancing the fabric across the width of the embroidery machine to an area where it is in position to be embroided, means for establishing a predetermined tension longitudinally and transversely in the fabric in the embroidery area, means for releasing the fabric after having been embroidered, and means for cutting the yarns extending between the embroidery machine and the embroidered fabric to free the fabric for advance and delivery of the next, immediately adjacent unembroidered section into embroidering position.

Thus the fabric is embroidered in successive lengths without interruption therebetween, and without the need for cutting and re-sewing, and without the fabric waste involved in machines heretofore employed.

The placement and advancement means includes an endless band carrying longitudinally-spaced pins for engagement with the fabric along one selvage, preferably the top. When first putting the machine into operation, the operator engages a few of the pins with the leading end of a fabric rolled off a bolt. Then the belt is actuated to move across the machine width, thereby carrying the fabric across the machine. Cooperating means are provided to cooperate with the pins to cause them successively to penetrate the fabric selvage. Advantageously such cooperating means comprises a roller having a penetrable surface, e.g. a wire brush roller, and the pins are caused to project through the fabric against the roller as a backup to ensure engagement. The pins may normally project vertically, i.e. parallel to the plane of the fabric. Accordingly, means are provided to deflect the belt near the fabric inlet so the pins temporarily project horizontally, i.e. transverse to the fabric, and thus can penetrate the fabric. Then the belt is released so the pins return to their vertical position. The selvage thus is horizontal but the fabric elsewhere hangs vertically.

At the downstream end of the machine means are provided to disengage the fabric selvage from the pins. Advantageously such means is a stationary guide, e.g. an inclined surface which lifts the fabric selvage off the pins as the belt and pins advance past the guide.

Transverse tension guides are provided at the upstream and downstream ends of the machine to hold the fabric under proper longitudinal tension. In addition, the resistance of the cooperating means helps tension the fabric longitudinally as it is placed on the pins.

To place the fabric under predetermined transverse tension and to ensure that it is smooth there is provided a band extending parallel to the fabric length and provided with spaced pins for engaging the other selvage of the fabric. The band is carried by a plurality of spaced leaf springs which are carried by carriers mounted for pivotal rotation about a shaft from inactive to active engaging position with the fabric. As the band moves toward the fabric from the rear a roller with a resilient surface approaches the fabric from the front; rolling thereof smoothes out the fabric and the roller serves as a backing surface for the fabric as the pins engage it; then the roller is restored to inactive position. Thereafter the leaf springs are caused to shorten up so as to move the pin band downwardly and thereby tension the fabric transversely. The tension can be pre-set and adjusted, as desired.

Embroidering is then effected in conventional manner and, upon the completion thereof, the threads are cut manually in conventional manner or by suitable knives to release the fabric for later movement.

Thereafter the leaf springs are lengthened to raise the band and release the transverse tension on the fabric, although the lower selvage still engages the pins on the band. The band is then moved toward the machine front, the pins carrying the fabric therewith. A horizontal wire extending the full machine width is then lowered in such manner as to push the fabric downwardly and off the lower pins, the wire then returning to inactive position.

The tension devices up and downstream of the embroidery area are then inactivated and the belt, carrying the pins engaging the upper selvage, is set in motion. This advances the fabric and a guide separates it from the pins, the fabric being taken up on a bolt. A new fabric section is thus positioned for the next embroidery cycle.

After the downstream fabric tensioning means is set, it can be adjusted visually or automatically to ensure that the new embroidery will mesh perfectly with the previous cycle so there will be no visible demarcation therebetween, the finished bolt having the appearance of a continuous uninterrupted length of embroidered goods.

The longitudinal tensioning means up and downstream may comprise rubber members bearing against a backup surface and adjustable in all directions. Conventional fabric tension gates may also be provided and even the unravelling of the fabric by rotation of the bolt imparts tension.

The belt which carries the pins for the upper selvage is flexible and endless, carrying substantially vertical pins. The wire brush roll which opposes the belt at the point of pin engagement with the fabric is idly mounted and rotates by movement of the belt. The roll which smoothes the fabric transversely and serves as an anvil during penetration of the lower fabric selvage by the pins is preferably made of Velcro but could be a brush or wire surface.

The lower machine elements can be made to be adjustable in elevation to accommodate fabrics of different widths. The fabric length is as long as desired and, when a bolt nears its end, a new bolt can be sewn thereto so rethreading of the machine is not necessary. In similar fashion, switching to another color or another fabric or another embroidery pattern can be effected without rethreading the machine.

The various drives can be actuated by mechanical and/or electrical means, although pneumatically actuated pistons may be operatively linked to various elements.

The invention will now be further described with reference to the accompanying drawings wherein.

Figure 1:
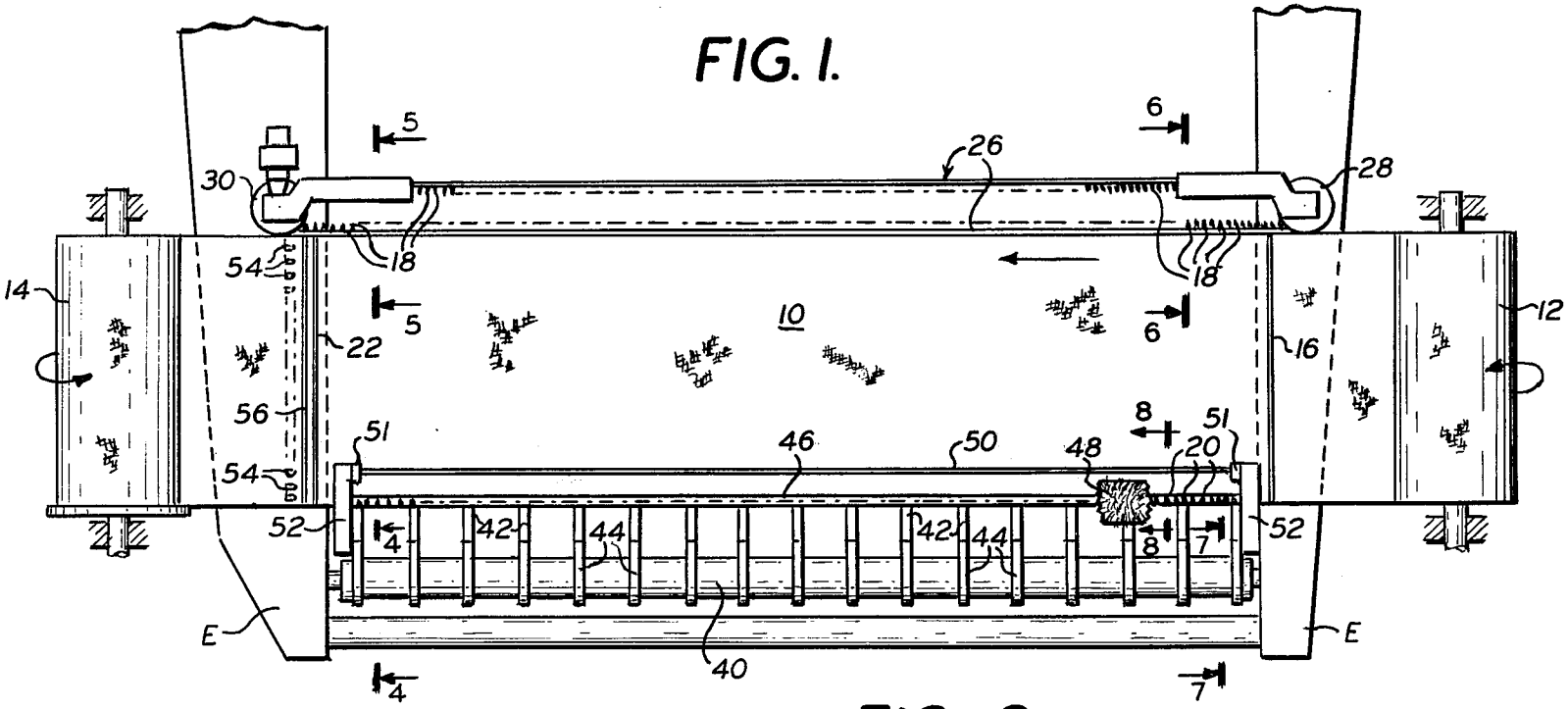
FIG. 1 is an elevation of a machine in accordance with the invention, along with a portion of the frame of a conventional embroidering machine.

Referring now more particularly to FIG. 1 there is shown a length of fabric 10 to be embroidered upon and extending from a feed bolt portion 12 to a collection bolt portion 14. From right to left the fabric 10 runs from portion 12 through a tension device 16, across the machine width held by pins 18 at the top (actually one edge) and pins 20 at the bottom (the other edge), past another tension device 22 and onto portion 14. The structure is added to the frame of a conventional embroidering machine E, so that at predetermined times the fabric 10 can be embroidered upon in conventional manner.

Figure 2:
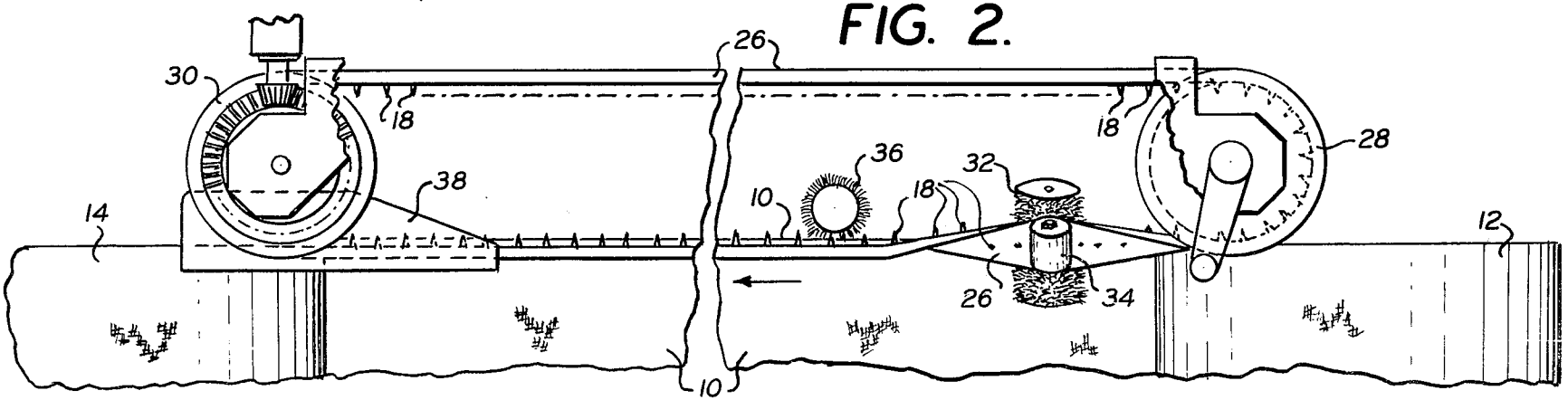
FIG. 2 is an enlargement of a portion of FIG. 1 showing how the fabric upper edge is engaged.
Figure 3:
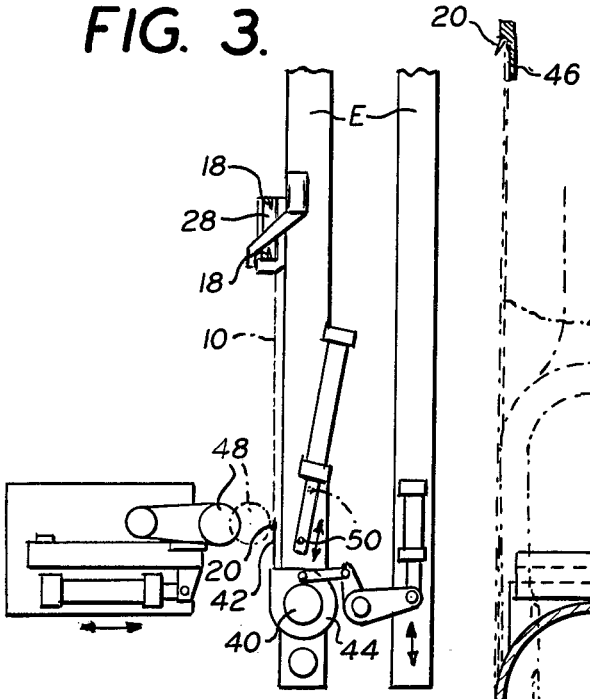
FIG. 3 is a side view of FIG. 1.

Toward the top of FIG. 1, and without fabric and on an enlarged scale in FIG. 2, there is shown an endless flexible conveyor belt 26 carrying the pins 18 for engaging the top of the fabric. The belt 26 is trained about pulleys 28 and 30 which are suitably grooved to accommodate inwardly projecting pins 18. The upper edge of the fabric 10 is only slightly above the level of the lower run of belt 26, the fabric contacting the far side of the belt as seen in FIG. 2. The fabric 10 passes a wire brush 32 mounted for free rotation about a vertical axis and, immediately opposite brush 32, is a guide 34. The belt 26 passes over guide 34 and is caused thereby to deflect 90° so that pins 18 project into the brush 32. This causes the pins to penetrate the fabric selvage and, after passage to the left beyond guide 34, the pins 18 retain the fabric and carry the fabric along when the belt 26 is moved. To the left of guide 34 the upper fabric selvage is no longer vertical but is now horizontal. A wire brush 36 idly mounted for rotation about a horizontal axis helps ensure the fabric selvage lies flat against the belt 26, fully engaged by pins 18.

At the left of FIG. 2 adjacent pulley 30 in an upwardly inclined guide surface 38 positioned just behind the line of pins 18. Consequently as the pin-engaged fabric 10 approaches pulley 30 it contacts the inclined guide 38 which lifts the fabric selvage off the pins 18, thereby effecting disengagement and restoring the selvage to vertical position.

Thus, at the start of an operation the machine operator threads the fabric through the tension device 16 and onto a few of the pins 18 at the right. Conveyor belt 26 is actuated and carries the fabric across the machine width, the operator then manually threading the leading fabric end onto the collection station. The fabric can then be embroidered upon and, when completed, the fabric is advanced so the next length is exactly registered for the next embroidering operation so that there is continuity and registry between successive embroiderings.

Figure 7:
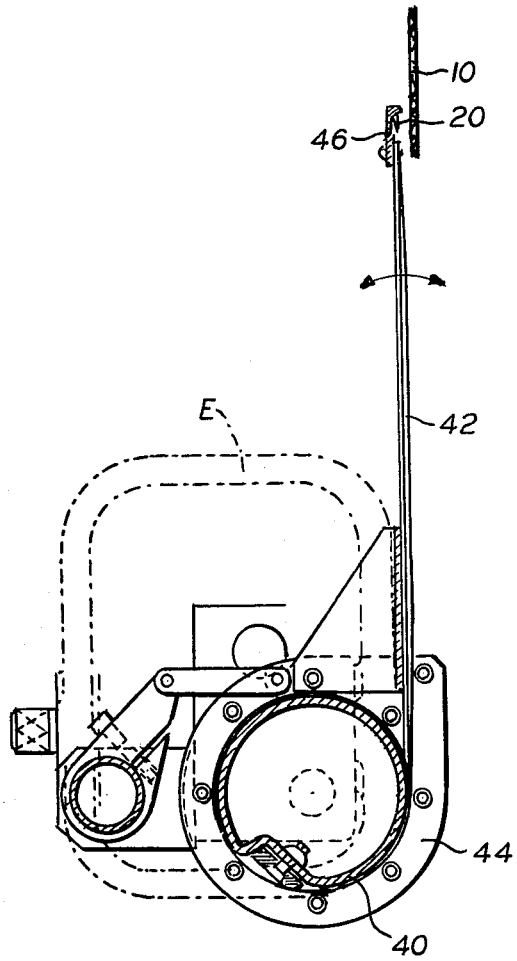
FIG. 7 is a section along line 7—7 of FIG. 1.

To permit embroidering to proceed properly, however, it is necessary that the fabric be smooth and under proper transverse tension as well and this is provided by the mechanism shown at the bottom of FIG. 1 and on a larger scale in FIG. 7. A rod 40 extends across the width of the machine and is capable of pivoting motion about its axis. At spaced locations along the rod 40 leaf springs 42 project therefrom, the lower end of each spring 42 being fixed to rod 40 and the spring partially encircling rod 40 because of shield 44. The upper end of each leaf spring 42 is attached to a transverse bar 46 parallel to rod 40 and carrying downwardly projecting pins 20. If the rod 40 pivots with shield 44 then it will cause the leaf springs 42 and bar 46 and pins 20 all to pivot as well between the position shown in phantom in FIG. 9 and that shown in full. The pins 20 in inoperative position are behind the fabric 10 as viewed in FIG. 1, projecting forwardly. Pivoting of the pins causes them to hit the fabric 10.

Figure 4:
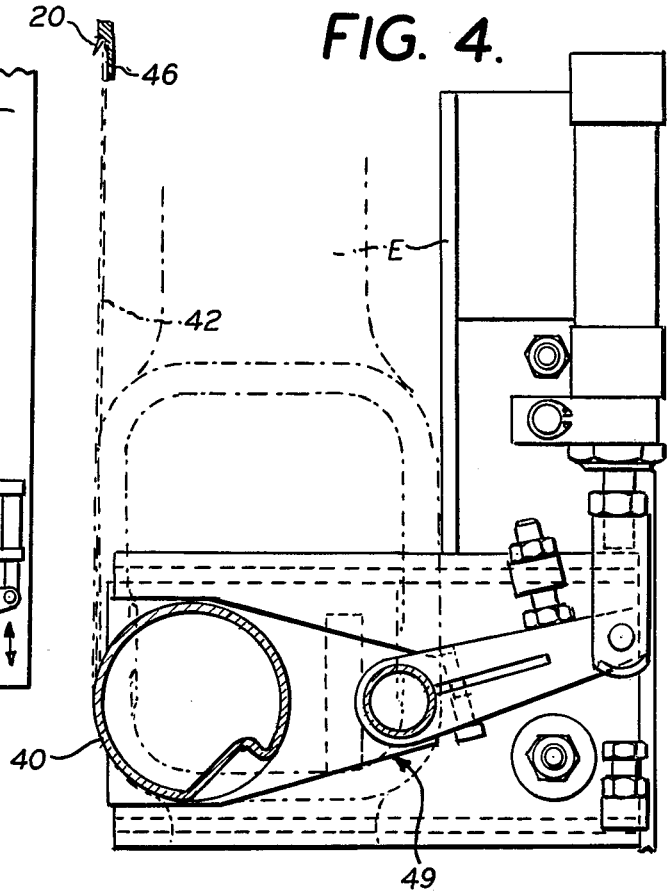
FIG. 4 is a section along line 4—4 of FIG. 1.
Figure 5:
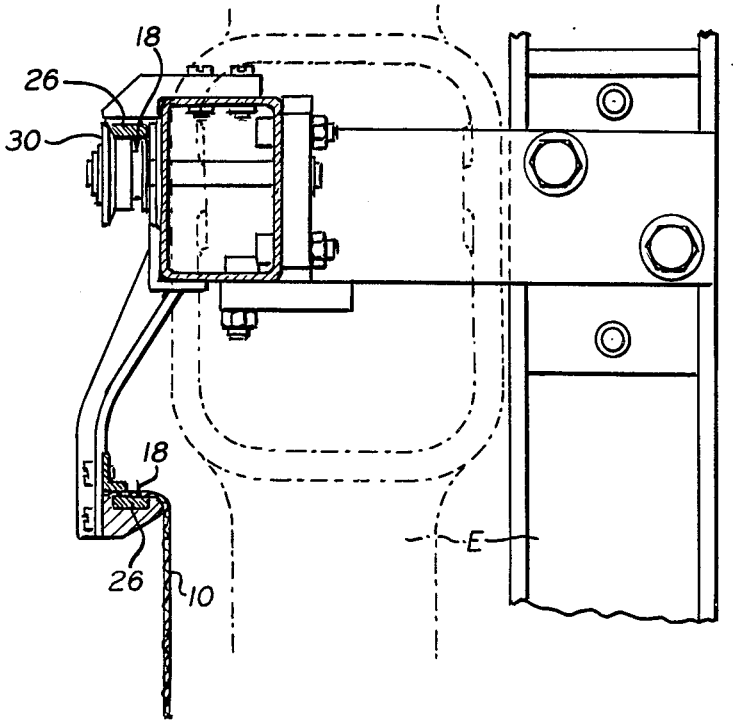
FIG. 5 is a section along line 5—5 of FIG. 1.
Figure 6:
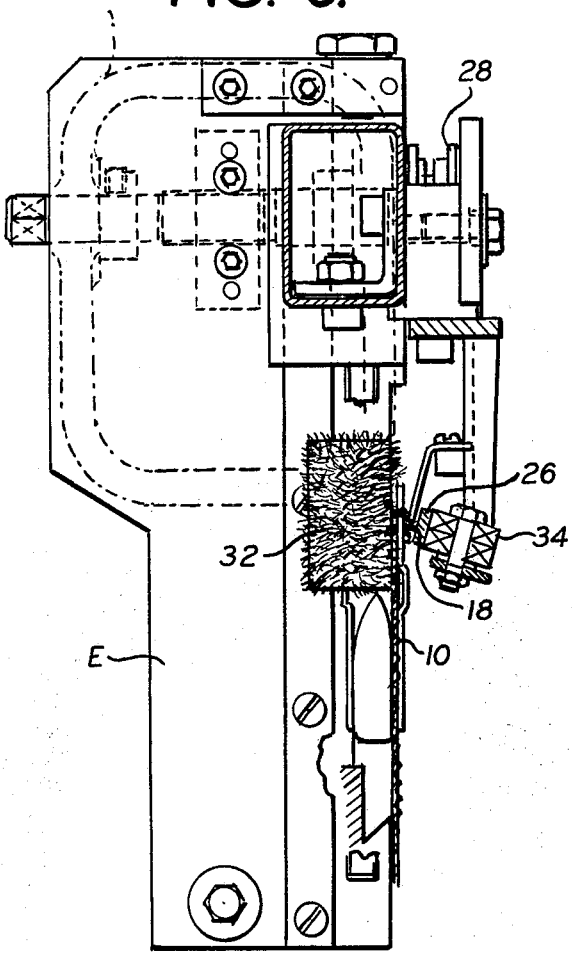
FIG. 6 is a section along line 6—6 of FIG. 1.

At the same vertical elevation as the pins 20 but in front of the fabric 10 is a roller 48 with a surface such as of Velcro. When the fabric 10 contacts the pins 20 the Velcro roller 48 rotates and brushes the fabric lower selvage onto the pins. This serves to smooth the fabric and at the same time ensure fabric engagement with pins 20. Thereafter by lever mechanism 49 the rod 40 is caused to pivot in clockwise direction as viewed in FIG. 4, without pivoting of shields 44. This causes leaf springs 42 to be wound about rod 40, pulling bar 46 down with pins 20 and thereby stretching or at least tightening fabric 10. The fabric 10 is now smooth and under predetermined tension so it is ready to be embroidered upon.

At the end of an embroidering operation there are hundreds of embroidering yarns extending between the embroidering machine E and the fabric 10 and these yarns must be cut before the fabric can be advanced. In addition, while the pins 18 can move across the machine width, in that regard the pins 20 are stationary. Consequently it is necessary to cut the yarns and to disengage the fabric 10 from pins 20 before the next embroidering operation. If desired, the yarns can be cut in conventional manner manually by an operator, or by a special apparatus, not shown.

Figure 9:
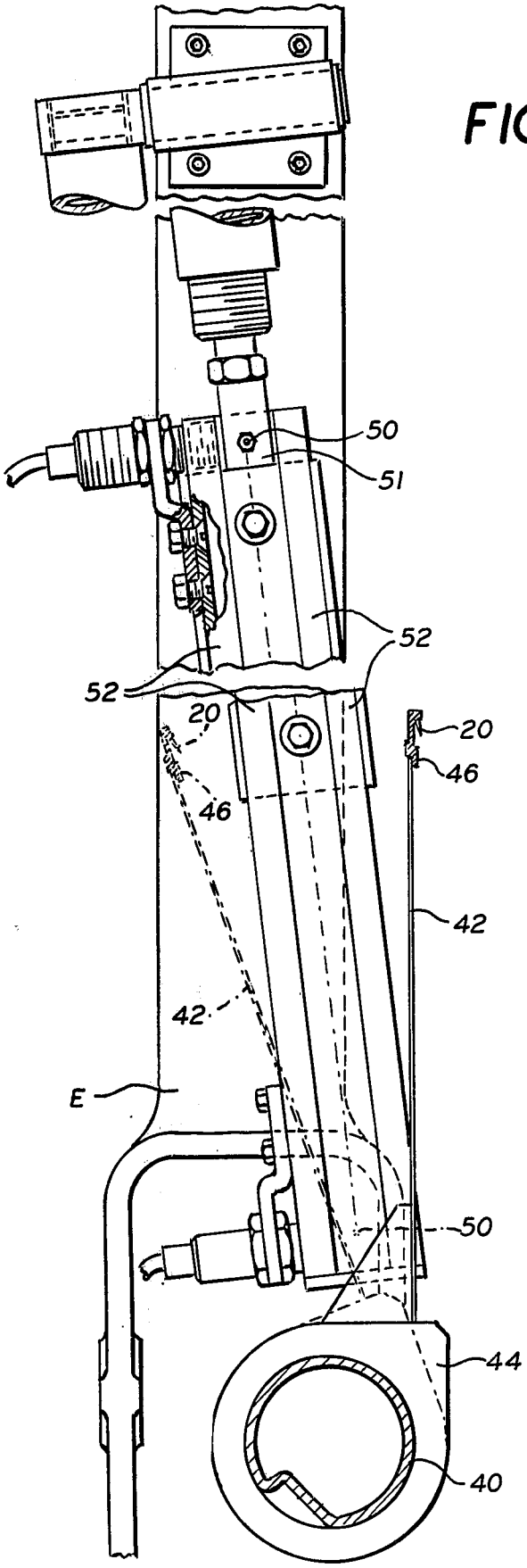
FIG. 9 is a section along line 9—9 of FIG. 1.

The mechanism which disengages the pins 20 from the fabric 10 is seen in some detail in FIG. 9. Specifically, at the end of the embroidering operation the rod 40 is pivoted counter-clockwise so the pins 20 are in the position shown in phantom. This causes the fabric to be displaced somewhat rearwardly, as viewed in FIG. 1, so it is inclined. This causes the fabric 10 to intersect the path of a release device such as a wire or rod 50 which extends across the machine width and at its ends is connected to a pair of track followers 51 which, pneumatically, are caused to move downwardly in tracks 52 and subsequently return, as desired. When the followers 51 move downwardly in tracks 52 this carries release member 50 downwardly to engage the fabric 10 and the forward and down movement of member 50 pushes the lower edge of the fabric off the pins 20. This frees the fabric 10 so that upon actuating belt 26 the fabric can be rolled up on collection bolt portion 14 as it is unrolled from feed bolt portion 12, thereby positioning a new unembroidered length of fabric in embroidering position.

Figure 10:
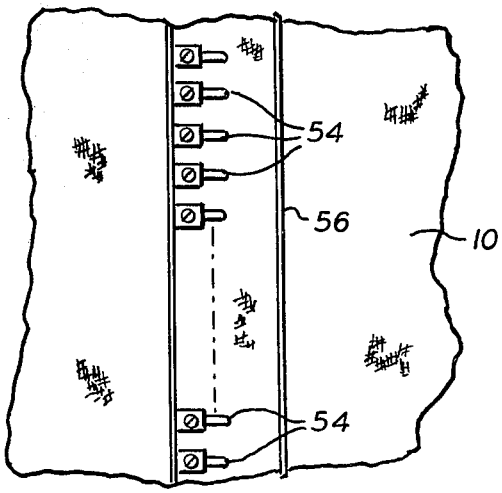
FIG. 10 is an elevation on an enlarged scale of a portion of FIG. 1 showing means for registering the line along which embroidering is to commence.
Figure 8:
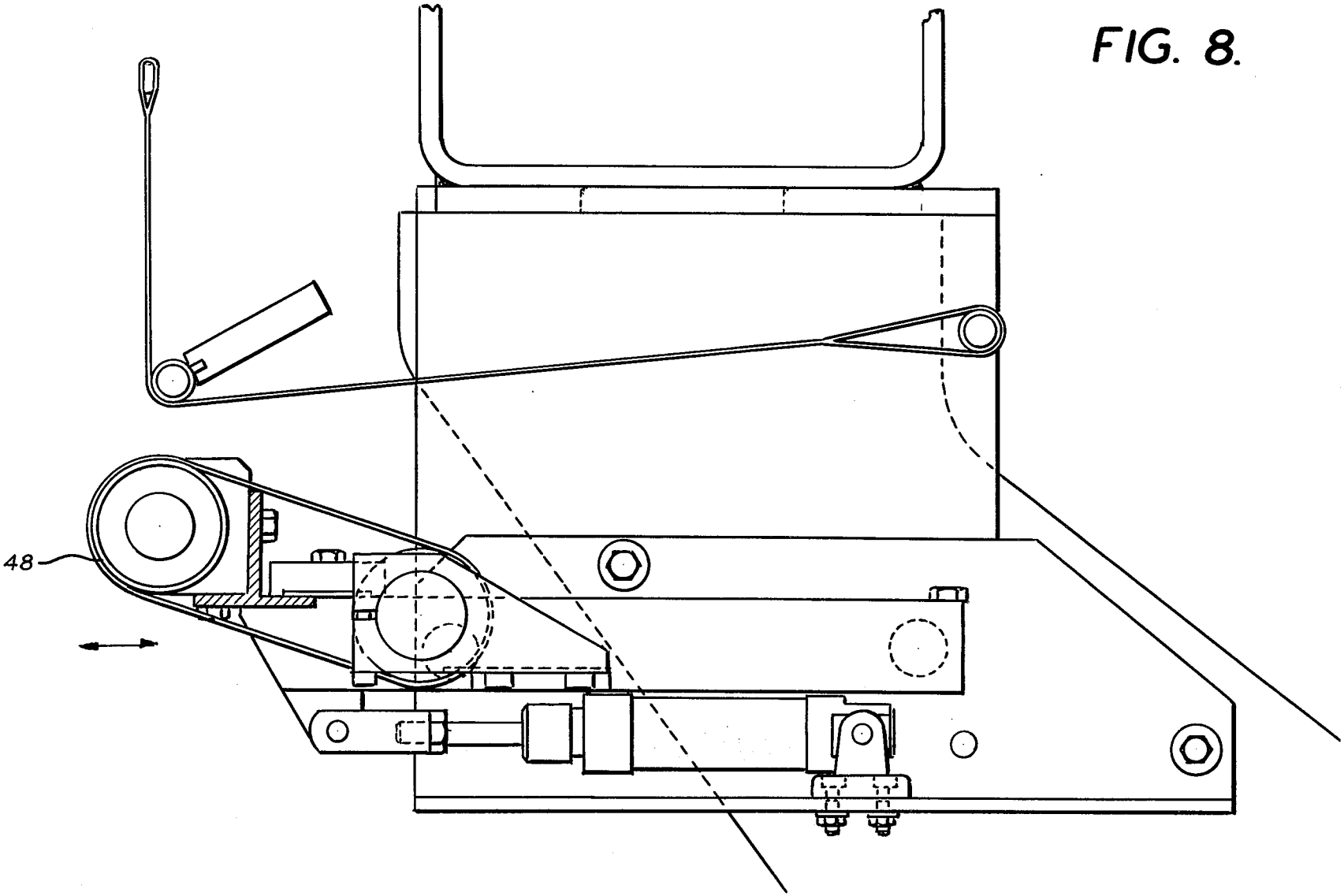
FIG. 8 is a section along line 8—8 of FIG. 1.

As can be seen in FIG. 10, adjacent the tension device 22 there are a plurality of gripping fingers 54 positioned vertically above one another alongside a vertical registry bar 56. The bar 56 indicates the vertical line where the next embroidered length of fabric will commence and this should be in registry with the end of the immediately preceding length of fabric. Since the end of the last embroidered length of fabric may not be in exact registry with bar 56, the machine operator manually adjusts the individual fingers 54 and fabric held thereby to effect such registry. The next embroidering operation is then ready to proceed.

When a bolt of fabric is almost exhausted, the tail end of the bolt can be sewn to the leading end of a new bolt so the operation can proceed without having to rethread the machine. Conversely at the collection end, the fabric can be cut when a predetermined length has been accumulated or the stitching between successive lengths can be cut to restore the original bolt lengths which can then be further processed in conventional manner.

Reviewing, the machine operates as follows: An operator pulls the leading edge of fabric 10 off feed bolt portion 12, threads it through tension device 16 and manually works its upper selvage onto a few pins 18. He then actuates belt 26 which carries pins 18 therewith and moves the fabric 10 across the machine width. At the downstream end, the operator takes the leading fabric end and guides it through tension device 22 onto collection bolt portion 14. As the belt moves along, the unravelling fabric engages new pins 18, being forced thereon by brush 32, and the leading fabric end disengages the pins by means of guide 38.

Rod 40 is pivoted to cause pins 20 to contact the lower edge of the fabric, Velcro roller 48 pivoting to serve as a backing for the fabric while the pins penetrate. Roller 48 rotates, at the same time smoothing out the fabric from top to bottom. Roller 48 is pivoted to inactive position and rod 40 is retracted so as to shorten leaf springs 42 and thereby tension the fabric transversely. Embroidering is then conducted in conventional manner.

At the end of embroidering, the embroidery yarns are severed from the fabric, bar 46 is pivoted to cause the fabric to incline, the leaf springs 42 are lengthened, and release device 50 is actuated to push fabric 10 off pins 20, release device 50 then being restored to initial position. Conveyor belt 26 is actuated to collect the fabric just embroidered upon and unroll new fabric, conveyor belt 26 is stopped, fingers 54 are manually and individually adjusted to ensure registry, the fabric bottom is engaged by pins 20 as before, and the cycle is repeated.

The various machine devices can be carried out with individual motors, gear trains, V-belts, and the like, but pneumatic hook-ups from a prime source of motive power has proven satisfactory.

It will be appreciated that the instant specification and examples are set forth by way of illustration and not limitation, and that various modifications and changes may be made without departing from the spirit and scope of the present invention.

What is claimed is:

1. An apparatus for making substantially endless lengths of embroidered fabric comprising in combination an embroidery apparatus and a fabric placement and advancement frame for positioning a fabric in an area to be embroidered by said embroidery apparatus and for advancing the embroidered fabric, said embroidery apparatus including means for piercing a fabric to be embroidered with yarns, said fabric and placement frame comprising means for taking the fabric from a supply, means for advancing the fabric across the width of the embroidery apparatus to said area, means for establishing a predetermined tension in the fabric in the area, a plurality of pins extending across the width of the embroidery apparatus near where one edge of the fabric is located, means for pivoting said pins so as to penetrate and engage the edge of the fabric, means for moving said pins after engagement so as to tension and fabric, and means for releasing the fabric after having been embroidered.

2. An apparatus according to claim 1, wherein said means for advancing the fabric comprises an endless conveyor extending across the width of the embroidery apparatus, a plurality of second pins projecting from said conveyor and spaced longitudinally therealong, means for engaging the second edge of the fabric with said second pins, and means for advancing said conveyor, whereby as said conveyor advances it carries the pin-engaged fabric therewith, the second edge of the fabric continuing to be engaged by new second pins as a new length of the fabric arrives at the engaging means.

3. An apparatus according to claim 2, including means for disengaging said fabric from said second pins at the downstream end of said conveyor.

4. An apparatus according to claim 2, wherein said conveyor is generally horizontally disposed with said second pins projecting vertically, said engaging means including means for turning said conveyor so that said second pins project approximately horizontally during only a portion of the endless path near the upstream end of the conveyor, and means for brushing the second edge of the vertically hanging fabric onto the horizontally projecting second pins, whereby when said conveyor is returned to horizontal position and said second pins return to vertical position said fabric edge is securely held by the second pins with the fabric hanging down therefrom.

5. An apparatus according to claim 1, wherein the means for releasing the fabric comprises a release member extending horizontally across the width of the embroidery apparatus, a track guiding said release member, means for moving said first pins so as to cause the first edge of said fabric to intersect the track of said release member, and means for moving said release member in its track to hit the fabric and force it off said first pins.

6. An apparatus according to claim 1, including means for registering the rear end of an embroidered section of the fabric relative to the embroidery apparatus, whereby when the next section of the fabric is embroidered upon its embroidery will be continuous with that of the section immediately preceding.

7. An apparatus according to claim 4, wherein the means for releasing the fabric comprises a release member extending horizontally across the width of the embroidery apparatus, a track guiding said release member, means for moving said first pins so as to cause the first edge of said fabric to intersect the track of said release member, and means for moving said release member in its track to hit the fabric and force it off said first pins, the apparatus further including an upwardly inclined guide at the downstream end of said conveyor to disengage said fabric from said upper pins, and means for registering the rear end of an embroidered section of the fabric relative to the embroidery apparatus, whereby when the next section of the fabric is embroidered upon its embroidery will be continuous with that of the section immediately preceding.

* * * * *